United States Patent [19]

Petermann et al.

[11] Patent Number: 4,519,166

[45] Date of Patent: May 28, 1985

[54] WORKPIECE HANDLING APPARATUS FOR GRINDING MACHINES

[75] Inventors: Harald Petermann, Nuremberg; Karl G. Loesch, Spardorf, both of Fed. Rep. of Germany

[73] Assignee: Georg Muller Kugellagen Fabrik K.G., Fed. Rep. of Germany

[21] Appl. No.: 409,039

[22] Filed: Aug. 18, 1982

[51] Int. Cl.[3] ..... B24B 5/22

[52] U.S. Cl. ..... 51/103 WH; 51/215 R; 51/238 GG; 414/224; 414/748

[58] Field of Search ..... 51/103 R, 103 WH, 215 R, 51/215 CP, 215 H, 238 GG, 290, DIG. 15; 414/222, 224, 748; 409/7; 198/339, 448

[56] References Cited

U.S. PATENT DOCUMENTS

| | | | |
|---|---|---|---|
| 2,912,798 | 11/1959 | Seidel et al. | 51/103 WH |
| 3,601,927 | 8/1971 | Kikuchi | 51/103 WH X |
| 3,619,951 | 11/1971 | Kikuchi et al. | 51/215 R X |
| 3,640,026 | 2/1972 | Flanigan | 51/215 R |
| 3,745,723 | 7/1973 | Kikuchi | 51/103 WH |
| 3,854,252 | 12/1974 | Lindsay et al. | 51/103 R X |
| 3,881,886 | 5/1975 | Hoare | 51/103 WH X |

*Primary Examiner*—Robert P. Olszewski
*Attorney, Agent, or Firm*—Steinberg & Raskin

[57] ABSTRACT

Workpiece handling apparatus for use in grinding machines wherein a pair of unground workpieces can be transported from holding or feed apparatus to a respective pair of load positions at the grinding wheel and simultaneously unload a pair of finished or ground workpieces from the load positions and transport the same to discharge apparatus. The handling apparatus include loading apparatus comprising three carriers which simultaneously transport each of a pair of unground workpieces from a respective pickup position at the holding apparatus to a respective one of the pair of load positions and at the same time simultaneously unload each of the pair of finished or ground workpieces from a respective load position and transport the same to the discharge apparatus. The loading apparatus also includes a device for lifting a pair of the ground workpieces from the respective load positions at least slightly away from the grinding wheel over respective substantially rectilinear paths to unload the finished workpieces from the respective load positions prior to transporting the finished workpieces to the discharge apparatus.

12 Claims, 6 Drawing Figures

FIG. 1
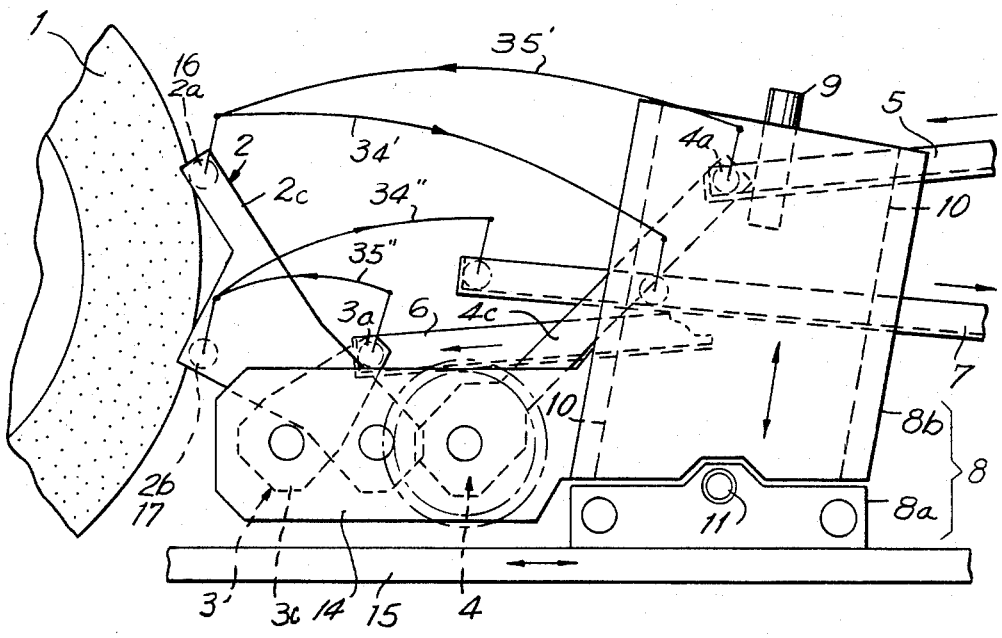
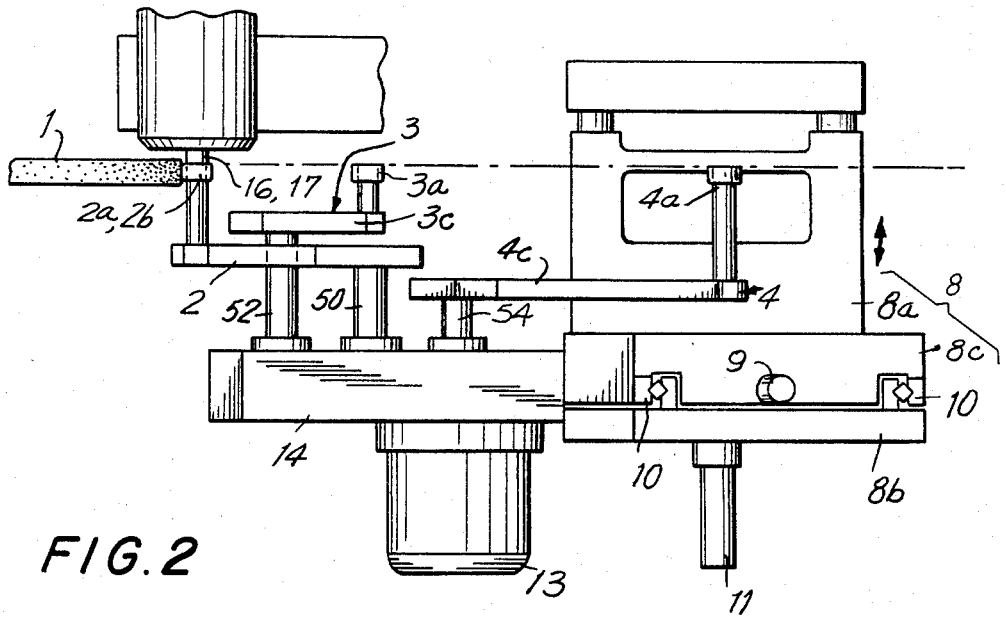
FIG. 2

WORKPIECE HANDLING APPARATUS FOR GRINDING MACHINES

BACKGROUND OF THE INVENTION

This invention relates generally to workpiece handling apparatus and, more particularly, to apparatus for handling workpieces for external grinding operations.

Handling apparatus are known for use in centerless grinding machines by which workpieces are automatically transferred or exchanged between a pickup position at holding means for unground workpieces and a load position at workpiece supporting means, e.g., sliding shoes, situated in operative relationship with a grinding wheel. Such conventional handling apparatus increase the rate of production of the grinding machine by reducing the time spent in loading and unloading the workpieces at the supporting means. More particularly, certain handling apparatus are known wherein an unground workpiece is transported from holding or feed means to the load position at the grinding wheel at the same time as a finished or ground workpiece is unloaded from the load position and transported to discharge means.

In this connection reference is made to U.S. Pat. No. 2,912,798 and German Pat. No. 1,954,487 which disclose apparatus for loading and unloading workpieces simultaneously in order to increase the rate of production of the machine. Such handling apparatus generally comprise pivotally mounted loading and unloading arms which carry a workpiece between loading and unloading positions.

However, conventional workpiece handling equipment of the type described above are definitely limited in that only a single workpiece can be ground at any one time and only a single workpiece can be loaded and unloaded subsequent to such grinding. Therefore, the rate of production of the grinding machine will not exceed a certain maximum value regardless of the speed at which the finished workpiece is unloaded from the load position and a new unground workpiece loaded in its place.

It is of course well recognized that the rate of production of a grinding machine can be increased by grinding two workpieces at the same time at respective staggered positions on the same grinding wheel. This technique however has not been fully utilized for the reason that although the actual grinding time per workpiece ground is reduced, the time required for transferring the unground workpieces to their respective load positions at the grinding wheel is increased. Thus, as noted above, conventional automatic handling apparatus of the type disclosed in the above-mentioned patents can only load a single unground workpiece and unload a single ground workpiece after the grinding operation. Therefore, it is seen that it is desirable to provide automatic workpiece handling apparatus whereby a pair of unground workpieces can be transported from holding or feed means to a respective pair of load positions at the grinding wheel and at the same time unload a pair of finished or ground workpieces from the load positions and transport the same to discharge means.

Problems arise in connection with the design of handling apparatus whereby a pair of unground workpieces are automatically transferred from a pair of pickup positions at holding means for unground workpieces to a pair of load positions at staggered locations on the circumference of a grinding wheel and wherein a pair of finished or ground workpieces are simultaneously transferred from the same load positions to discharge means for the finished workpieces. More particularly, it is generally necessary that the workpieces be ground in a rapid manner with precise accuracy. In order to obtain such speed and accuracy in a centerless grinding machine equipped with sliding shoes for supporting the workpiece, the shoes must be positioned with respect to each other at an optimal angular relationship and such that the workpiece is sufficiently enveloped thereby. However, since workpiece handling apparatus of the type described above, i.e., wherein the workpiece is held at the end of pivot arms which swing back and forth to perform the loading and unloading of the workpieces, require that a free path be maintained for the workpiece over the entire length of its motion while held on the end of the pivot arm, it has not been possible to obtain the optimal positioning of the sliding shoes where two workpieces are adapted to be loaded at staggered locations along the periphery of the circumference of the grinding wheel. Thus, the rear or upper sliding shoe would interfere with the path of a pair of workpieces being transferred to such staggered loading or chucking positions. Moreover, it would appear that the workpieces which could be handled would be limited in size in order to avoid mutual interference during transfer.

SUMMARY OF THE INVENTION

Accordingly, it is an object of the present invention to provide new and improved automatic handling apparatus whereby a pair of unground workpieces are transported from holding or feed means to a respective pair of load positions at the grinding wheel and at the same time unload a pair of finished or ground workpieces from the load positions and transport the same to discharge means.

Another object of the present invention is to provide new and improved handling apparatus of the type described above having a relatively uncomplicated construction.

Still another object of the present invention is to provide new and improved handling apparatus of the type described above which is capable of handling even larger workpieces.

Briefly, in accordance with the present invention, these and other objects are attained by providing in a grinding machine which includes a machine frame on which a grinding spindle head is mounted on which a grinding wheel is fixed and chucking apparatus defining a pair of workpiece chucking locations staggered on the periphery of the grinding wheel and wherein either the grinding spindle head or the workpiece chucking apparatus is mounted on a carriage which is movable in the longitudinal direction to perform the feed-in travel while the other is fixed, handling apparatus including a loading mechanism which comprises a pair of pivoted loading arms adapted to transport each of a pair of unground workpieces from holding or feed means to a respective one of the pair of workpiece chucking locations and a single pivoted unloading arm adapted to unload a pair of finished or ground workpieces from the chucking positions and transport the same to discharge means. The loading and unloading arms are coupled through a suitable transmission to swing in unison so that the transport of the pairs of finished and unfinished workpieces occurs simultaneously.

The loading mechanism also functions such that the finished or ground workpieces are disengaged from the grinding wheel immediately after the grinding operation by moving the same over a short upward stroke which is slightly inclined away from the grinding wheel. In this manner, the sliding shoes can be arranged so that the operation of the handling apparatus of the present invention compares favorably with conventional single workpiece handling apparatus. In the illustrated embodiment, the transmission to which the three pivot arms are mounted is itself mounted on a lift housing whose stroke is inclined relative to the vertical so that the short upward stroke of the workpieces is accomplished by raising the lift housing at the appropriate time. The combination of the three pivot arms for loading and unloading the workpieces and the short upward motion of the workpieces out of the chucking locations provide conditions for simultaneously grinding a pair of workpieces which has the same effectiveness as the conventional single workpiece transfer technique.

In handling apparatus using pivoted loading and unloading arms, the unground workpieces being transported toward the workpiece chucking positions will pass closest to the finished or ground workpieces being transported toward the discharge means at an area about midway between the chucking locations and the workpiece feed or holding means. The distance between the workpiece receivers associated with the loading and unloading arms at this point defines the largest possible outer diameter of the workpiece. It will be understood that in handling apparatus of the type wherein two workpieces are loaded and unloaded at the same time, this distance is even smaller than in the case of single workpiece handling apparatus. In order to provide the handling apparatus of the present invention with the capability of handling even larger workpieces, in accordance with one embodiment of the present invention, the pivoted unloading arm which transports the pair of finished or ground workpieces to the discharge means is constituted by a pair of members which are hinged or pivoted to each other so that the one of the members which carries the pair of finished workpieces can be tiltingly rotated as soon as the linear lift-out stroke is completed to an appropriate extent such that the paths of the finished or ground workpieces are substantially coincident and fall substantially midway between the two outer paths followed by the unground workpieces as the latter are transported towards the respective chucking locations.

The handling apparatus of the present invention can operate in a fully automatic manner to load and unload various kinds of workpieces of the type having an external surface at least a portion of which is symmetrical with respect to an axis and finds particular applicability to annular workpieces, such as bearing races. It is possible to perform external or plunge grinding of two workpieces simultaneously. Moreover, a particular advantage of the handling apparatus of the present invention is in its relative simplified construction including only three pivot arms coupled to move in unison to simultaneously transport four workpieces for each loading operation.

DESCRIPTION OF THE DRAWINGS

A more complete understanding of the present invention and many of the attendant advantages thereof will be readily appreciated by reference to the following detailed description when considered in connection with the accompanying drawings in which:

FIG. 1 is a schematic elevation view of one embodiment of the handling apparatus of the present invention;

FIG. 2 is a top plan view of the apparatus illustrated in FIG. 1;

DESCRIPTION OF THE PREFERRED EMBODIMENTS

Figure 2A:
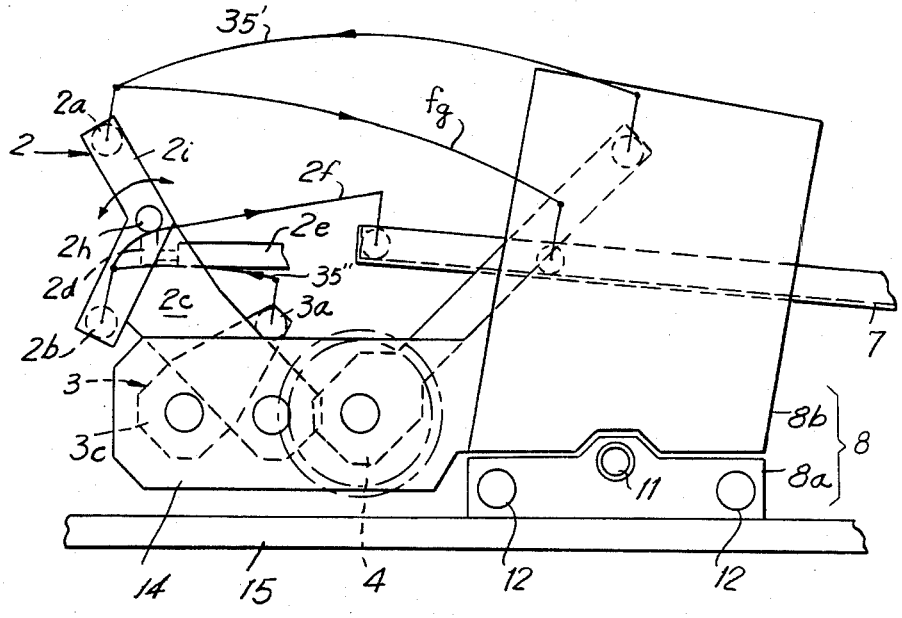
FIG. 2*a* is a view similar to FIG. 1 illustrating another embodiment of the unloading arm and with components being omitted for the sake of clarity.

Referring now to the drawings wherein like reference characters designate identical or corresponding parts throughout the several views, and more particularly to FIGS. 1 and 2 thereof, the general construction and operation of one embodiment of workpiece handling apparatus in accordance with the present invention is described hereinbelow. The apparatus is adapted to handle workpieces which are normally ground in a centerless grinding operation, i.e., workpieces having surfaces which are symmetrical with respect to an axis, such as an annular bearing race.

A grinding wheel 1 is mounted on a spindle head which itself is rotatably mounted on a machine frame which is not shown for purposes of clarity. Suitable lubrication equipment is of course provided as is conventional in order to cool the workpieces as they are ground. Upper and lower feed chutes 5 and 6 for holding respective pluralities of unground workpieces are fixed to the machine frame. The chutes 5 and 6 are mounted in a common plane and are inclined downwardly towards the grinding wheel 1. The lower end of each chute has a lip which engages the leading unground workpiece in each chute to hold the same in a respective pick-up position as best shown in FIG. 1. A discharge chute 7 fixed to the machine frame is mounted in the same plane as the feed chutes and is inclined downwardly away from the grinding wheel 1. The discharge chute 7 is adapted to receive the ground or finished workpieces as described below. A main carriage 15 is mounted on the machine frame and is adapted to travel in a longitudinal direction, i.e., towards and away from the grinding wheel 1, to effect the feed-in or grinding of the workpieces during the grinding operation.

The handling apparatus includes a workpiece loading mechanism, designated 8, which is mounted on the main carriage 15 and which receives the unground workpieces from the pick-up positions on the respective feed chutes 5 and 6 and handles the same in a manner described below. The loading mechanism 8 thus moves with the machine carriage 15 which travels towards the grinding wheel 1 a distance equal to the thickness of the material to be ground from the workpieces and, subsequent to the grinding operation, travels a corresponding distance away from the grinding wheel.

The loading mechanism 8 includes a base plate 8*a* which is rigidly connected to an upstanding guide plate 8c which is inclined at least slightly away from the grinding wheel, and a lift housing 8b mounted over base plate 8a to which a transmission housing 14 is rigidly connected. A transversely extending guide rail is provided on the upper surface of base plate 8a which is received in a corresponding transverse channel formed in the bottom surface of lift housing 8b so that the lift housing 8b of the loading mechanism 8 can be guided in a transverse direction over carriage 15 for reasons explained hereinbelow. A pneumatic or hydraulic cylinder 11 is provided to transversely advance and retract the lift housing 8b over plate 8a, the lift housing 8b being guided by the above-described rail and channel structure.

Moreover, the lift housing 8b is mounted on a pair of parallel rectilinearly extending roller-type ways 10 which, as best seen in FIG. 1, are housed within guide plate 8c and extend generally upwardly from base plate 8a and which are slightly inclined away from the grinding wheel. Thus, the lift housing 8b and transmission housing 14 of the loading mechanism 8 can be lifted or raised on ways 10 with respect to the base plate 8a and main carriage 15 and then lowered back to its original position on base plate 8a. A pneumatic or hydraulic piston-cylinder arrangement 9 is provided to accomplish the lifting and lowering of the lift housing 8b.

A transmission housing 14 is rigidly connected to the lift housing 8b so as to form an integral part of the loading mechanism 8. An unloading arm 2 is pivotally mounted on transmission housing 14 which functions to simultaneously carry a pair of ground or finished workpieces after completion of the grinding operation from respective workpiece chucking or holding positions 16 and 17 at grinding wheel 1 and then simultaneously deposit the two finished workpieces at respective delivery locations on the discharge chute 7. In the embodiment of the invention illustrated in FIGS. 1 and 2, the unloading arm 2 is constituted by a unitary plate 2c which is fixed at one end to a shaft 50 mounted for reversing rotation in the transmission housing 14 as described hereinbelow. A pair of workpiece receivers in the form of rods 2a and 2b are each connected at one of their ends to the plate 2c to form a part of the unloading arm 2. The other ends of the rods 2a and 2b are adapted to be received or inserted within the bores of a respective pair of workpieces when the workpieces are held at chucking positions 16 and 17. The plate 2c is sized and configured such that when the unloading arm 2 is in its pick-up position as shown in FIGS. 1 and 2, the workpiece receivers 2a and 2b are vertically aligned one over the other in axial alignment with the chucking positions 16 and 17 as described below. As seen in FIG. 1, the plate 2c is undercut or bifurcated in the region between the workpiece receivers 2a and 2b to provide a clearance space for the grinding wheel. Furthermore, the discharge chute 7 is appropriately positioned so that when the unloading arm 2 is swung to its unloading position as described below, the finished workpieces carried on the workpiece receivers 2a and 2b will be simultaneously deposited on the discharge chute 7 at respective locations thereon.

A pair of loading arms, namely an upper loading arm 4 and a lower loading arm 3, are also pivotally mounted on the transmission housing 14. The loading arms 4 and 3 function to simultaneously carry a pair of unground workpieces from their respective pick-up positions on the upper and lower feed chutes 5 and 6 to respective chucking positions 16 and 17. The loading arms 3 and 4 are respectively constituted by plates 3c and 4c which are fixed to the shafts 52 and 54 which are mounted for reversing rotation in the transmission housing 14. Workpiece receivers in the form of rods 3a and 4a are each connected at one of their ends to plates 3c and 4c to form a part of the respective loading arms 3 and 4. The other ends of rods 3a and 4a are adapted to be receivable or insertable within the bores of a respective pair of workpieces which are held at their respective pick-up positions on the feed chutes 6 and 5. The plates 3c and 4c are sized and configured such that when the loading arms 3 and 4 are in their pick-up positions as shown in FIGS. 1 and 2, the workpiece receivers 3a and 4a are axially aligned with the bores of the leading unground workpieces in feed chutes 5 and 6. Furthermore, the loading arms 3 and 4 are appropriately configured so that when they are swung to their feed positions, as described below, the unground workpieces carried on the workpiece receivers 3a and 4a will be simultaneously carried to their respective chucking positions 17 and 16. A pneumatically or hydraulically operated rotary drive 13 is fixed to the transmission housing 14 for pivotally swinging the unloading and loading arms in synchronism as described below.

The operation of the handling apparatus of the present invention will now be described. For purposes of description, it is assumed that the handling apparatus of the present invention is substantially in the configuration shown in FIGS. 1 and 2. Thus, the lift housing 8b is in its lower position relative to main carriage 15, i.e., is adjacent at its lower surface with the upper surface of base plate 8a. However, the lift housing 8b is in its transversely retracted position relative to main carriage 15, i.e., is transversely positioned on base plate 8a such that the free ends of workpiece receivers 2a and 2b of unloading arm 2 do not extend into the bores of the pair of respective workpieces held in the chucking positions 16 and 17 at the grinding wheel 1. The free ends of workpiece receivers 3a and 4a do not extend into the bores of a pair of workpieces situated in the pick-up positions on lower and upper feed chutes 6 and 5 by virtue of the retracted transverse position of the lift housing 8b. The pair of workpieces which are in the chucking positions are supported on respective sliding shoes and chucked magnetically as described below in connection with FIG. 3.

The workpieces at the chucking positions 16 and 17 are ground as follows. The main carriage 15 is advanced toward the grinding wheel until the desired amount of material is ground from the workpieces held at the chucking positions 16 and 17 whereupon the travel of the carriage 15 is reversed to return to its original position. It will be understood that the loading mechanism 8 including the unloading and loading arms 2, 3 and 4 will move together with the carriage 15 during the feed stroke of the grinding operation as well as during the return stroke thereof. At the end of or during the return stroke of the carriage 15, the cylinder 11 is actuated and the lift housing 8b is transversely advanced relative to the carriage whereupon the free ends of the workpiece receivers 2a and 2b are inserted into the bores of the ground workpieces as seen in FIGS. 1 and 2. At the same time the free ends of the workpiece receivers 3a and 4a of loading arms 3 and 4 are inserted into the bores of the leading workpieces situated in the pick-up positions on feed chutes 6 and 5. The cylinder 9 is actuated to lift the lift housing 8b on ways 10. Since the transmission housing 14 is rigidly connected to the lift housing 8*b*, the unlocking arm 2 including the workpiece receivers 2*a* and 2*b* which are received in the bores of the pair of ground workpieces are thereby also raised by the lift housing 8*b* whereupon the pair of ground workpieces are lifted from their respective sliding shoes. In a more detailed description of this movement is set forth hereinbelow in conjunction with FIG. 3.

With the lift housing 8*b* in its raised position, the rotary piston drive 13 is activated to swing the unloading arm 2 from its loading position shown in FIGS. 1 and 2 to its unloading position thereby carrying the pair of ground workpieces on workpiece receivers 2*a* and 2*b* from the respective chucking positions over paths 34′ and 34″ to deposit them at respective locations on the discharge chute 7. At the same time the loading arms 4 and 3 are swung from their pick-up position shown in FIGS. 1 and 2 to their loading positions and thereby carry a pair of unground workpieces on the associated workpiece receivers 4*a* and 3*a* from their respective pick-up positions on feed chutes 5 and 6 over paths 35′ and 35″ to deposit them at the chucking positions 16 and 17.

When the exchange of workpieces described above has been completed, the lift housing 8*b* is lowered by cylinder 9. This results in the new unground workpieces held on workpiece receivers 3*a* and 4*a* to be mounted on the sliding shoes 37 and 40 (FIG. 3) where they are chucked magnetically in a conventional manner. The main carriage 15 then begins its feed-in stroke. During this feed-in stroke, i.e., as the newly chucked workpieces are being ground, the lift housing 8*b* and loading and unloading arms 2, 3 and 4 connected thereto through transmission housing 14 are transversely retracted until all the workpiece receivers are withdrawn from the workpiece bores.

The two ground workpieces, having been deposited in the discharge chute 7 by the unloading arm 2, will now move freely and will roll under gravity down the inclined discharge chute 7 for subsequent machining or assembly. The unloading arm 2 then swings back to the workpiece chucking positions 16 and 17 and at the same time the loading arms 3 and 4 swing back to their respective pick-up positions. In the meantime, two new unground workpieces will have rolled into the respective pick-up positions on the feed chutes 5 and 6. The lift housing 8*b* and associated loading and unloading arms are then transversely advanced by cylinder 11 until the free ends of the workpiece receivers 2*a*, 2*b*, and 3*a* and 4*a* are inserted into the bores of the respective workpieces. At the conclusion of the grinding operation, the workpiece exchange operation described above is again initiated.

As noted above, the unloading arm 2 and loading arms 3 and 4 are moved by the rotary piston drive 13. The transmission housed within transmission housing 14 is designed such that the arms move in unison. Thus, while the unloading arm swings from the workpiece chucking locations 16 and 17, the loading arms 3 and 4 move simultaneously from their pick-up positions proximate to the workpiece feed chutes to the workpiece chucking positions. The workpieces so carried on the loading and unloading arms pass closest to each other during the changing operation after the arms have rotated through about $\frac{1}{2}$ of their respective angles of rotation.

As best seen in FIG. 2, the plates 2*c*, 3*c* and 4*c* of the unloading and loading arms lie in different vertical planes. Moreover, the pick-up positions in the feed chutes 5 and 6, the discharge position on the discharge chute 7 and the axis of rotation defined by shafts 50, 52 and 54 of the loading and unloading arms are selected as shown such that the paths 34′, 34″, 35′ and 35″ of the workpieces do not interfere with each other for even the largest workpiece to be ground.

Referring now to FIG. 2*a*, another embodiment of handling apparatus in accordance with the present invention is shown which is particulary suited for use where workpieces having especially large outer diameters are to be ground. The embodiment of the handling apparatus illustrated in FIG. 2*a* is essentially the same as that illustrated in FIGS. 1 and 2 except for the construction of the unloading arm 2. Accordingly, the feed chutes and other common features have been omitted from FIG. 2*a* for purposes of clarity.

As noted above, the finished or ground workpieces and unground workpieces pass closest to each other during the changing operation after the loading and unloading arms have been swung about half-way through their respective strokes. This mutual spacing of course defines the limit of the maximum diameter of the workpieces which can be handled without interference occuring during operation. It will be appreciated that this spacing is smaller in machines according to the present invention wherein two pairs of workpieces pass each other during the workpiece changing operation as compared to a single workpiece grinding machine. In accordance with the embodiment of the invention illustrated in FIG. 2*a*, in order to enable the apparatus to handle workpieces having the largest possible dimensions, the unloading arm is formed of two plate members 2*c* and 2*i* which are pivoted to each other about a pivot point 2*h*. The plate member 2*c* is pivotally mounted for swinging movement in the transmission housing 14 while plate member 2*i* constituted by a substantially V-shaped member is pivotally connected to plate member 2*c* at its apex. The workpiece receivers 2*a* and 2*b* are fixed to and extend from the ends of the plate member 2*i* so that when the unloading arm 2 is in the position shown in FIG. 2*a*, the positions of workpiece receivers 2*a* and 2*b* correspond to the positions of the workpiece receivers 2*a* and 2*b* illustrated in the embodiment of FIGS. 1 and 2. A lever 2*d* is fixed to plate member 2*i* and is connected to the piston of a piston-cylinder arrangement 2*e* coupled to the frame. When the unloading arm 2 starts its pivoting motion towards the discharge chute 7, the piston-cylinder arrangement 2*e* is actuated to pivot plate member 2*i* with respect to plate member 2*c* about axis 2*h* until the workpiece receivers are situated in a substantially horizontal plane. The workpiece are then carried on the unlocking arm 2 along paths 2*f* and 2*g* which will be seen to be closer to each other than are paths 34′ and 34″ in FIG. 1. Thus, a correspondingly larger clearance is provided between these paths and those of the new unground workpieces being carried to the chucking positions at the same time. Accordingly, larger workpieces may be handled without danger of interference during the changing operation. The new unground workpieces are swung along the original paths designated 35′ and 35″.

Figure 3:
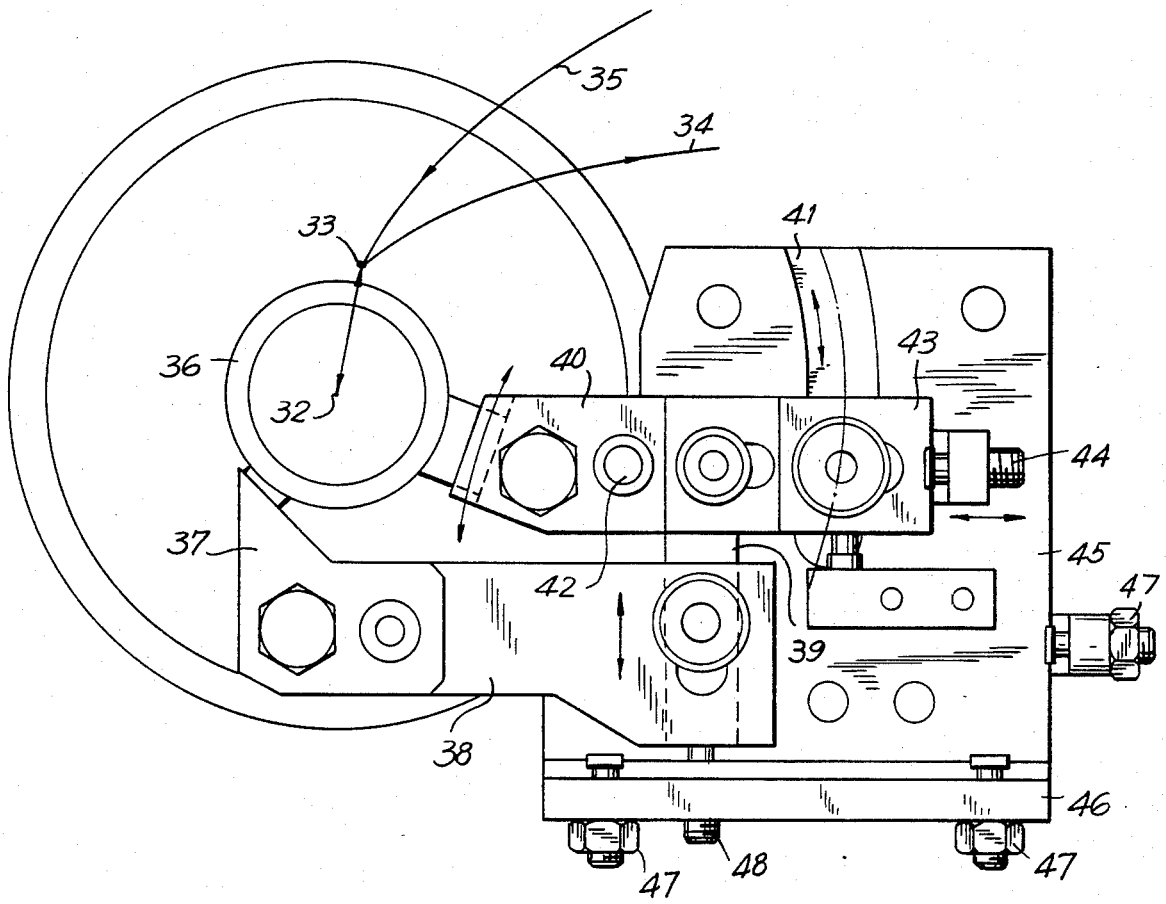
FIG. 3 is an elevation view of one embodiment of a seat for the workpieces at a typical load position illustrating two sliding shoes and a plane magnetic driver.

Referring now to FIG. 3, a typical centerless grinding assembly and workpiece drive associated with one of the chucking positions 16 and 17 is shown which is particularly suited for accommodation within a limited space. It is understood that two of such assemblies are provided, one at each chucking position 16 and 17, preferably in vertical alignment with each other so that the workpiece centers are perpendicular to the slideways of the main carriage 15 and precisely vertically aligned with each other. Moreover, it is preferred that the horizontal center lines through the workpieces are precisely symmetrically arranged with respect to the center line through the grinding wheel 1.

Each grinding assembly includes a lower sliding shoe 37 and an upper sliding shoe 40 which together hold a workpiece, designated 36, during the grinding operation. As explained above, at the beginning of the workpiece changing operation, i.e., when the finished or ground workpiece 36 is about to be carried from the chucking position to the discharge chute 7, the workpiece 36 is raised a small linear distance from the workpiece spindle center, designated 32, to a lift-out point 33 by means of the lift housing 8*b* being raised on ways 10. In order to accommodate this movement, the sliding shoe 40 is mounted on a guide plate 45 so as to be rotatable about a fulcrum point 42. In this manner, the sliding shoe 40 is pivotable upwardly through a limited angle under the force of the ground workpiece as the same is being lifted. The ground workpiece is then transported by the unloading arm 2 from the chucking position along the path 34 without interference with the sliding shoe 40.

In the meantime, an unground workpiece is brought by one of the loading arms 3 and 4 to the lift-out point 33 along the path 35. When the lift housing 8*b* is lowered to its original position, the unground workpiece is lowered to the workpiece spindle center 32 whereupon the upper sliding shoe 40, previously rotated upwardly, is swung back into its normal operating position by the workpiece being lowered.

The sliding shoe 37 is rigidly fastened to a holding plate 38 which is movably mounted in a longitudinal slot 39 formed in the guide plate 45 by an adjusting screw 48. Moreover, the upper sliding shoe 40 is mounted in a holding plate 43 so as to be linearly movable by means of an adjusting screw 44. The upper and lower sliding shoes engage the outer surface of the workpiece to define a central angle between them which is adjustable through the pivoting of the holding plate 43 within a curved slot 41. Three adjusting screws 47 function to adjust the position of the guide plate 45 relative to the sliding shoe base plate 46.

Thus, by providing that the workpieces travel over a relatively short, rectilinear distance, i.e., between points 32 and 33, which is slightly inclined away from the grinding wheel at the point of contact of the workpiece and grinding wheel, it is therefore possible to provide a pair of chucking locations which are staggered over the circumference of the grinding wheel. Moreover, by providing that the upper sliding shoe is pivotable to a position which does not interfere with the path of the workpiece, the relative angular positions of the two sliding shoes and the central angle defined between them can be optimized to attain a rapid grinding operation having a high degree of accuracy.

Figure 4:
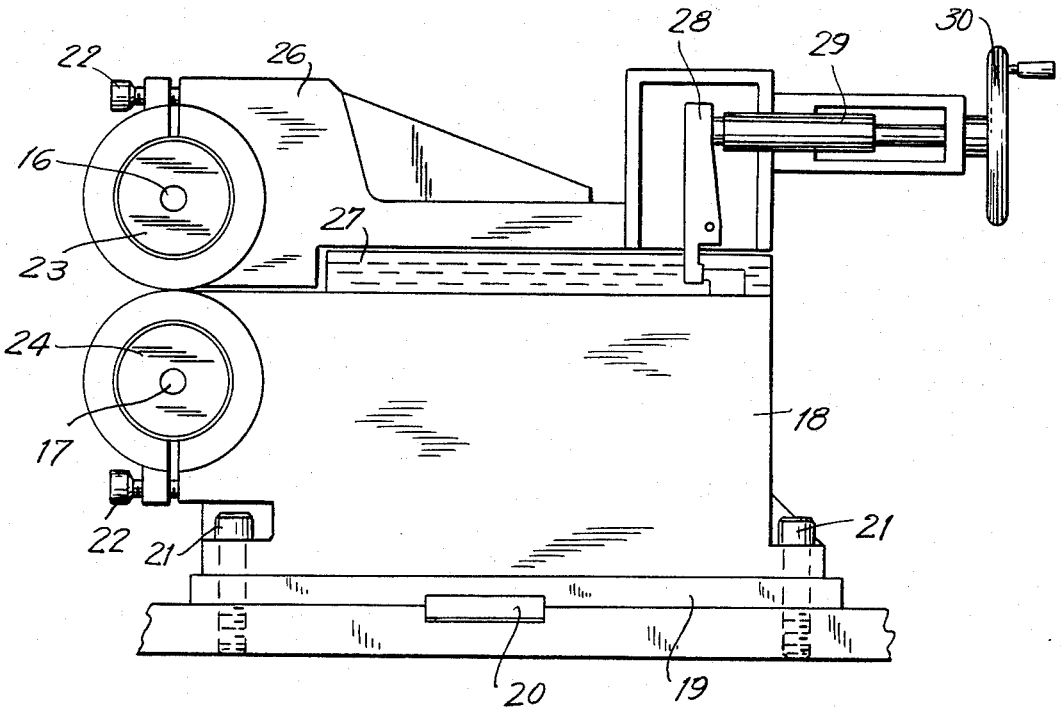
FIG. 4 is a schematic elevation view of workpiece spindle stock for use in connection with the present invention, various components of the machine being omitted for the sake of clarity.
Figure 5:
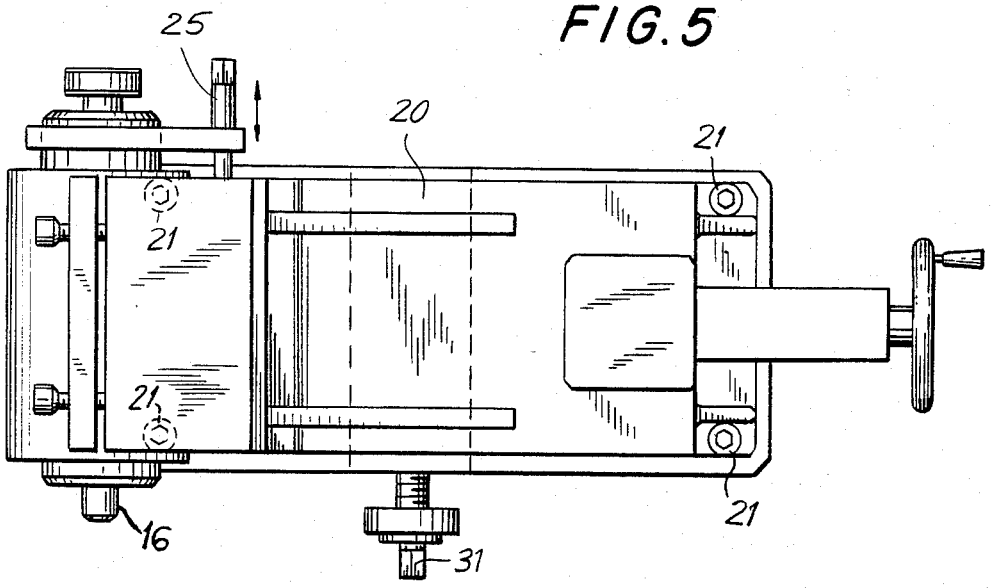
FIG. 5 is a top plan view of the apparatus illustrated in FIG. 4.

Referring now to FIGS. 4 and 5, apparatus is illustrated for selectively adjusting the position of the workpiece spindles in order to locate the two workpieces to be ground in precise symmetrical relationship with respect to the grinding wheel and in order to correct any changes in the workpiece chucking locations relative to each other. The handling apparatus of the present invention has been omitted from FIGS. 4 and 5 for the sake of clarity.

A workpiece spindle stock 18 is rigidly fastened, such as by screws, to a guide table 19 which itself is clamped to the main carriage 15 by four preloaded spring-tensioned clamping screws 21. The spring preload is selected such that the guide table 19 and workpiece spindle stock mounted thereon are adjustably movable transversely over the main carriage 15 by means of a threaded member 31. A guide strip or key 20 fixed to the guide table 19 runs in a corresponding transverse slot formed in the guide table and serves as means for guiding the transverse movement of the spindle stock 18.

An upper spindle holder 26 is movable in a longitudinal direction relative to the main carriage 15 over a pair of roller ways 27. In this manner, the vertical alignment of the two workpiece chucking positions 16 and 17 can be adjusted. Thus, the upper spindle holder may be selectively moved longitudinally by means of a threaded spindle 29 operable through a hand wheel 30, which spindle cooperates with a lever 28 for moving the upper spindle holder.

The upper workpiece spindle 23 and lower workpiece spindle 24 are each mounted in their respective housings by a pair of spring-tensioned clamping bolts 22. The clamping force is selected such that the workpiece spindles are held securely in their respective housings and such that each workpiece spindle can be independently moved axially within its housing without loosening the clamping bolt through the rotation of a respective threaded spindle 25.

Obviously, numerous modifications and variations of the present invention are possible in the light of the above teachings. For example, the grinding wheel itself may be mounted for movement towards the workpieces rather than the workpieces being mounted on a movable carriage. The apparatus may be used for surface or plunge grinding and various types of workpieces may be handled by the invention. Accordingly, the present invention is not limited by the specific embodiments described herein and it is therefore understood that within the scope of the claim appended hereto, the invention may be practiced otherwise than as specifically disclosed herein.

What is claimed is:

1. Workpiece handling apparatus for use in a grinding machine including a rotatable grinding wheel, comprising:

means for supporting a pair of workpieces at a respective pair of spaced load positions staggered on the periphery of the grinding wheel;

means for moving said workpiece supporting means and grinding wheel toward each other in a longitudinal direction in order to feed the pair of workpieces supported on said supporting means against the grinding wheel in a grinding operation;

means for holding unground workpieces so that each of a pair of unground workpieces is situated at a respective pickup position of a pair of pickup positions;

discharge means for receiving finished or ground workpieces;

loading means for simultaneously transporting each of the pair of unground workpieces from said respective pickup position at said holding means to said respective one of said pair of load positions and at the same time simultaneously unloading each of a pair of finished or ground workpieces from said respective load position and transporting the same to said discharge means, said loading means including three carrier arms, said three carrier arms comprising one unloading arm and two loading arms, said unloading arm including means for carrying both of the pair of finished workpieces to unload and transport the same from said respective load positions to said discharge means, said two loading arms each including means for carrying the respective one of the pair of unground workpieces from said respective pickup position at said holding means to said respective one of said pair of load positions;

means associated with said unloading arm for effecting engagement thereof with both of the pair of finished workpieces at said respective load positions and for effecting disengagement thereof at said discharge means;

means associated with each of said two loading arms for effecting engagement thereof with the respective one of the pair of unground workpieces at said respective one of said pair of pickup positions and for effecting disengagement thereof at said respective one of said pair of load positions; and including means for lifting the pair of ground workpieces from said respective load positions at least slightly away from the grinding wheel over respective substantially rectilinear paths to unload the finished workpieces from said respective load positions prior to transporting the finished workpieces to said discharge means; and means for moving said carrier arms in unison, each of said carrier arms being pivotally mounted on said carrier moving means.

2. The combination of claim 1 wherein said lifting means includes a transmission housing rigidly connected to a lift housing and on which said carrier arms are pivotally mounted, and means for lifting said lift housing upwardly in a substantially rectilinear path in a direction at least slightly away from the grinding wheel.

3. The combination of claim 1 wherein said means for effecting engagement and disengagement of said unloading and loading arms with said workpieces include workpiece receiver means associated with each of said carrier arms, and means for transversely moving said carrier arms so that said workpiece receiver means can selectively engage and disengage the workpieces.

4. Workpiece handling apparatus for use in a grinding machine including a rotatable grinding wheel, comprising:

means for supporting a pair of workpieces at a respective pair of spaced load positions staggered on the periphery of the grinding wheel;

means for moving said workpiece supporting means and grinding wheel toward each other in a longitudinal direction in order to feed the pair of workpieces supported on said supporting means against the grinding wheel in a grinding operation;

means for holding unground workpieces including a pair of feed chutes, one located above the other so that each of a pair of unground workpieces is situated at a respective position of a pair of pickup positions;

discharge means for receiving finished or ground workpieces and comprising a discharge chute, at least a portion of which is situated between said pair of feed chutes;

loading means including up to three carriers for simultaneously transporting each of the pair of unground workpieces from said respective pickup position at said holding means to said respective one of said pair of load positions and at the same time simultaneously unloading each of a pair of finished or ground workpieces from said respective load position and transporting the same to said discharge means, and including means for lifting the pair of ground workpieces from said respective load positions at least slightly away from the grinding wheel over respective substantially rectilinear paths to unload the finished workpieces from said respective load positions prior to transporting the finished workpieces to said discharge means; and means for removing said carriers in unison.

5. The combination of claim 4 wherein said feed chutes are inclined downwardly toward said load positions and wherein said discharge chute is inclined downwardly away from said load positions.

6. Workpiece handling apparatus for use in a grinding machine including a rotatable grinding wheel, comprising:

means for supporting a pair of workpieces at a respective pair of spaced load positions staggered on the periphery of the grinding wheel;

means for moving said workpiece supporting means and grinding wheel toward each other in a longitudinal direction in order to feed the pair of workpieces supported on said supporting means against the grinding wheel in a grinding operation;

means for holding unground workpieces so that each of a pair of unground workpieces is situated at a respective pickup position of a pair of pickup positions;

discharge means for receiving finished or ground workpieces;

loading means for simultaneously transporting each of a pair of unground workpieces from said respective pickup position at said holding means to said respective one of said pair of load positions and at the same time simultaneously unloading each of a pair of finished or ground workpieces from said respective load position and transporting the same to said discharge means, said loading means including three carrier arms, said three carrier arms comprising one unloading arm and two loading arms, said unloading arm including means for carrying both of the pair of finished workpieces to unload and transport the same from said respective load positions to said discharge means along a pair of respective discharge paths, said two loading arms each including means for carrying the respective one of the pair of unground workpieces from said respective pickup positions at said holding means to a respective one of said pair of load positions along a pair of respective feed paths, said pair of discharge paths being situated between said pair of feed paths, and including means for lifting the pair of ground workpieces from said respective load positions at least slightly away from the grinding wheel over respective substantially rectilinear paths to unload the finished workpieces from said respective load positions prior to transporting the finished workpieces to said discharge means; and means for moving said carrier arms in unison, each of said carrier arms being pivotally mounted on said carrier moving means.

7. The combination of claim 6 wherein said load arm includes a substantially V-shaped portion including an undercut portion providing a clearance space for the grinding wheel.

8. The combination of claim 6 wherein said load positions include a first lower load position and a second upper load position located above said first load position and wherein a first one of said pickup positions is situated below and closer to said load positions than the other second pickup position, and wherein a first one of said load arms which carries an unground workpiece from said first pickup position to said first load position is pivotally mounted on said carrier moving means at a location closer to said load positions than the location at which the second one of said load arms which carries an unground workpiece from said second pickup position to said second load position is pivotally mounted on said carrier moving means, and wherein said first load arm is shorter than said second load arm.

9. The combination of claim 8 wherein said unloading arm is pivotally mounted to said carrier moving means to a location between the locations at which said first and second load arms are mounted thereto.

10. The co

11. A grinding machine and workpiece handling apparatus for use therewith comprising:

a grinding wheel rotatably mounted in a machine frame;

a main carriage;

means mounted on the main carriage for supporting a pair of workpieces at a pair of spaced staggered load positions around the periphery of said grinding wheel;

means for moving the grinding wheel and main carriage toward each other for feeding the pair of workpieces supported in the load positions during a grinding operation;

means for holding unground workpieces so that each of a pair of unground workpieces is situated at a respective pickup position of a pair of pickup positions;

discharge means for receiving finished or ground workpieces; and a loading mechanism mounted on said main carriage including a lift housing mounted for movement over a short, straight stroke upwardly and slightly away from said grinding wheel, a transmission housing coupled to said lift housing, and three carrier arms mounted to said transmission housing for pivotal movement, said three carrier arms comprising one unloading arm and two loading arms, said unloading arm including means for carrying both of the pair of finished workpieces to unload and transport the same from respective load positions to said discharge means along a pair of respective discharge paths, said two loading arms each including means for carrying a respective one of the pair of unground workpieces from a respective pickup position at said holding means to a respective one of said pair of load positions along a pair of respective feed paths.

12. The combination of claim 11 wherein said pair of discharge paths are situated between said pair of feed paths.

* * * * *